US011311099B1

(12) United States Patent
Charters

(10) Patent No.: US 11,311,099 B1
(45) Date of Patent: Apr. 26, 2022

(54) TOILET BRUSH SYSTEM

(71) Applicant: Don Charters, Vancouver (CA)

(72) Inventor: Don Charters, Vancouver (CA)

( * ) Notice: Subject to any disclaimer, the term of this patent is extended or adjusted under 35 U.S.C. 154(b) by 0 days.

(21) Appl. No.: 16/357,190

(22) Filed: Mar. 18, 2019

(51) Int. Cl.
*A46B 17/06* (2006.01)
*A46B 9/00* (2006.01)

(52) U.S. Cl.
CPC ..... *A46B 17/06* (2013.01); *A46B 9/005* (2013.01); *A46B 2200/304* (2013.01)

(58) Field of Classification Search
CPC ... A46B 17/06; A46B 9/005; A46B 2200/304; A46B 11/0093; A47K 11/10
USPC ..... D30/158; 15/186–188, 39, 184, 142; 134/44; 422/300
See application file for complete search history.

(56) References Cited

U.S. PATENT DOCUMENTS

| | | | | |
|---|---|---|---|---|
| 3,982,296 | A | 9/1976 | Russo | |
| 4,918,769 | A | 4/1990 | Gandini | |
| 5,259,406 | A | 11/1993 | Hofmann | |
| 5,941,379 | A | 8/1999 | Barardo | |
| 5,945,076 | A | 8/1999 | Leonard | |
| 6,842,935 | B2 | 1/2005 | Peterson | |
| 7,299,519 | B1 * | 11/2007 | Garry | A46B 7/023 15/104.05 |
| 7,594,291 | B1 | 9/2009 | Carmen | |
| 8,403,580 | B2 * | 3/2013 | De Laforcade | A45D 40/267 401/122 |
| 8,915,355 | B2 * | 12/2014 | Monson | A46B 11/001 206/15.3 |
| 8,931,494 | B2 | 1/2015 | Weis | |
| 9,226,571 | B1 | 1/2016 | Belitz | |
| 9,464,424 | B1 | 10/2016 | Wiltshire | |
| 9,622,629 | B1 * | 4/2017 | Brittain | A47K 11/10 |
| 9,943,197 | B2 | 4/2018 | Shabat | |
| 2002/0054784 | A1 | 5/2002 | Wolf | |
| 2004/0159330 | A1 | 8/2004 | Anemone | |
| 2010/0263691 | A1 | 10/2010 | Fresquez | |
| 2011/0162983 | A1 | 7/2011 | Weis | |
| 2011/0253180 | A1 | 10/2011 | Davidson | |
| 2013/0152980 | A1 | 6/2013 | Hues | |
| 2014/0083471 | A1 | 3/2014 | Lian Tangstad | |
| 2016/0331194 | A1 | 11/2016 | Stewart | |

* cited by examiner

*Primary Examiner* — Katina N. Henson
(74) *Attorney, Agent, or Firm* — Quickpatents, LLC; Kevin Prince

(57) ABSTRACT

A toilet brush system includes a toilet brush cleaner for cleaning a toilet brush of the type having an elongated handle with a proximal end and a distal end terminating in a brush head having a plurality of projecting brush bristles. The toilet brush cleaner comprises an elongated handle with a proximal end and a distal end that terminates in an open-ended sleeve sized to accommodate the distal end of the brush therein. The sleeve has a plurality of resilient, inwardly-projecting radial nubs, preferably made from an elastomeric material. In use, with the user holding the handle of the brush cleaner in one hand and the handle of the toilet brush in another hand, the user can repeatedly insert and withdraw the brush from the open sleeve, preferably while rotating the brush and within a flow of water in a toilet, to clean the brush head with the nubs.

20 Claims, 5 Drawing Sheets

TOILET BRUSH SYSTEM

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to bathroom accessories, and more particularly to a toilet brush system.

BACKGROUND

This invention relates specifically to cleaning a toilet brush, and is intended to be used after the brush has been used to clean a toilet bowl and, in all likelihood, may still retain remnants of the toilet related bacterial debris such as scum, urine and fecal material.

Before the advent of the present invention, if a user is truly hygienically inclined, extra time must be expended after a toilet bowl cleaning in order to get the brush itself clean; this is typically accomplished by swishing and swirling the brush in the water of the toilet bowl, and as such these actions sometimes fall short of being truly effective.

Another technique of brush cleaning is that of holding the toilet brush to the rushing action of the water of a toilet flush. This technique, of course, depends on the available water flow of the toilet being used, and the likelihood of rotating the brush to bring all of its bristles into contact with the water flow, a maneuver which proves difficult for some people.

Many people do not clean the brush at all, often due to the extra effort required, and in such cases the dirty brush might be considered to be a weak link in the overall objective of a home cleanliness and of a truly sanitary bathroom. In such scenarios, fecal debris and bacterial scum debris remain on the brush head and can drip down onto whatever area the brush was being stored in, such as a floor, cupboard, or a specially provided toilet bowl dish or base that often is included with such toilet brush purchases. Such bacterial material remains in the bathroom/house if the brush is not properly cleaned.

There is a contemporary movement underway, where considerable peer pressure is applied, for citizens to be as clean and germ free as possible; allowing an unclean toilet brush in one's home runs counter to this objective.

Therefore, there is a need for a device that provides for not only easy cleaning of a toilet with a toilet brush, but also for easy cleaning of the toilet brush itself. Such a needed invention would allow the user to clean the brush quickly and efficiently, particularly with clean water flushed in a toilet. Such a needed device would further provide for a simple means of storing both the toilet brush and the toilet brush cleaner. The present invention accomplishes these objectives.

SUMMARY OF THE INVENTION

The present device is a toilet brush cleaner for cleaning a toilet brush of the type having an elongated handle with a proximal end adapted for gripping and a distal end terminating in a brush head having a plurality of projecting brush bristles. In some embodiments a toilet brush cleaning system includes both the toilet brush cleaner and the toilet brush.

The toilet brush cleaner comprises an elongated handle with a proximal end adapted for gripping and a distal end that terminates in an open-ended sleeve sized to accommodate the distal end of the brush therein. The sleeve has a plurality of resilient, inwardly-projecting radial nubs, preferably made from an elastomeric material.

In use, with the user holding the brush cleaner in one hand and the toilet brush in another hand, the user can repeatedly insert and withdraw the brush from the open sleeve, preferably while rotating the brush, to clean the brush head with the nubs of the sleeve. While cleaning the brush head it is helpful to insert both the sleeve and the brush head under water in a toilet, for example. For additional cleaning and rinsing the user may flush the toilet and hold the sleeve and brush head in the flow of the flushed water while cleaning the brush within the sleeve.

Preferably the sleeve of the toilet brush cleaner includes at least one water deflector fixed at a top edge of the sleeve, such that the deflector when introduced into the flow of flushed water in the toilet redirects a substantial portion of the flushed water into the sleeve to rinse the brush head and nubs. In some embodiments of the invention a base is included and adapted to receive and maintain in an upright orientation the sleeve and the brush on a horizontal support surface, such as a floor surface.

The present invention is a device that provides for not only easy cleaning of a toilet with a toilet brush, but also for easy cleaning of the toilet brush itself. The present invention allows the user to clean the brush quickly and efficiently, particularly with clean water flushed in a toilet. The present device further provides for a simple means of storing both the toilet brush and the toilet brush cleaner in an aesthetically-pleasing manner. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
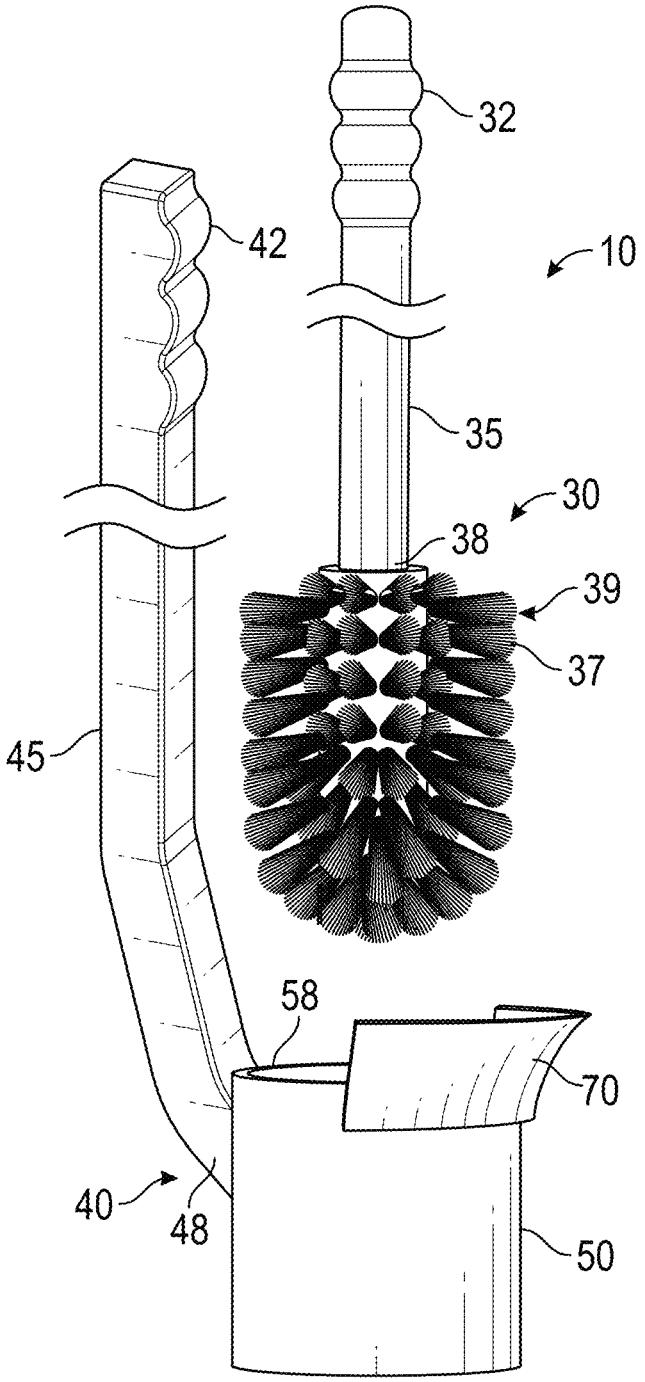
FIG. 1 is an exploded view of a toilet brush cleaner and toilet brush, illustrated as separated with the toilet brush aligned with a sleeve of the toilet brush cleaner.
Figure 2:
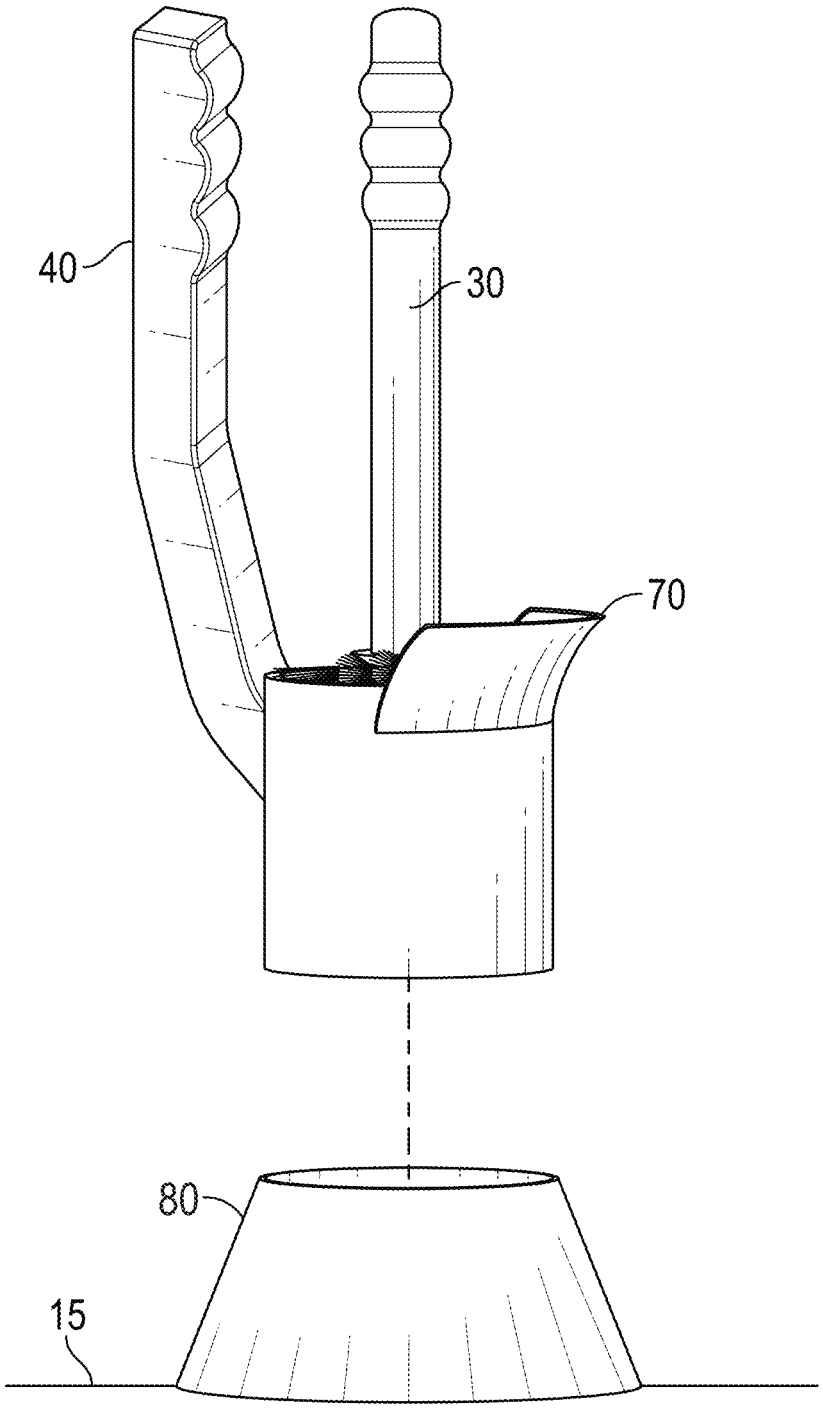
FIG. 2 is a side elevational view showing a toilet brush head of the toilet brush fully engaged with the sleeve of the toilet brush cleaner, and further illustrating an optional base for holding the toilet brush and toilet brush cleaner, when engaged, in an upright orientation on a floor surface.
Figure 3:
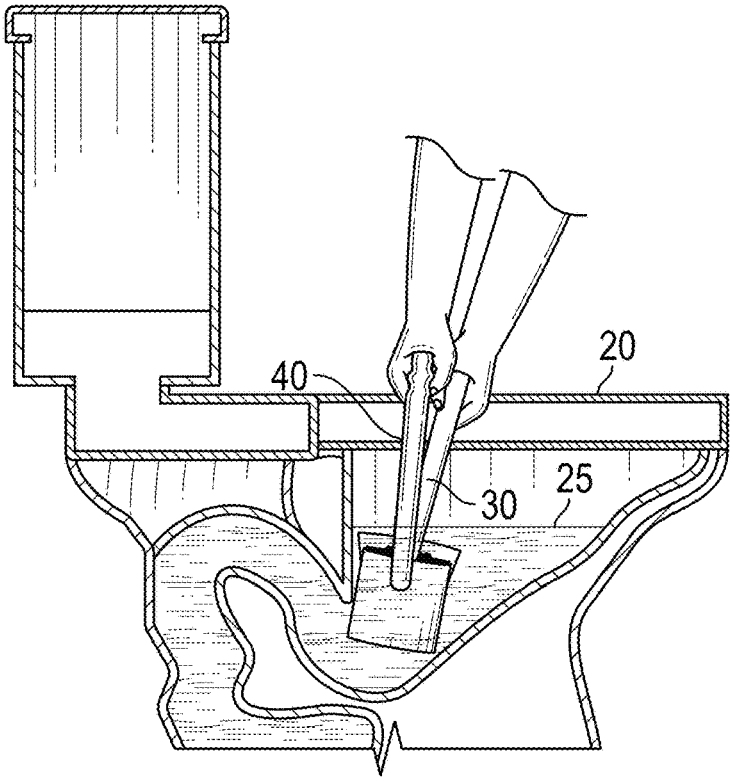
FIG. 3 is a side cross-sectional diagram of a toilet showing a user cleaning the toilet brush with the toilet brush cleaner under water within the toilet.

FIGS. 1-3 illustrate a toilet brush cleaner 40 for cleaning a toilet brush 30 of the type having an elongated handle 35 with a proximal end 32 adapted for gripping and a distal end 38 terminating in a brush head 39 having a plurality of projecting brush bristles 37. In some embodiments a toilet brush cleaning system 10 includes both the toilet brush cleaner 40 and the toilet brush 30. Such a toilet brush 30 is preferably made with a strong, substantially rigid plastic handle 35 and resilient nylon or other easily-cleaned brush bristles 37. The length of the elongated handle 35 is preferably between 35 and 45 cm.

The toilet brush cleaner 40 comprises an elongated handle 45 with a proximal end 42 adapted for gripping and a distal end 48 that terminates in an open-ended sleeve 50 sized to accommodate the distal end of the brush 30 therein. Such a toilet brush cleaner 40 is preferably made with a strong, substantially rigid plastic handle 45 and sleeve 50, and preferably the handle 45 and the sleeve 50 are integrally formed. The sleeve 50 is preferably between 6 cm and 8 cm in diameter, and the length of the elongated handle 45 is preferably between 35 and 45 cm.

Figure 5A:
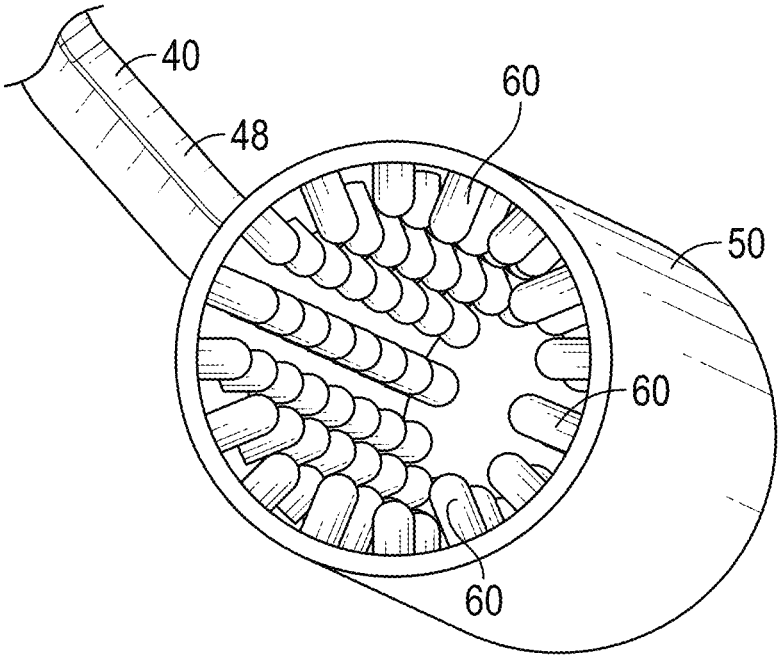
FIG. 5A is a partial perspective view of the sleeve of the toilet brush cleaner, illustrating nubs of the sleeve positioned radially about the sleeve.
Figure 5B:
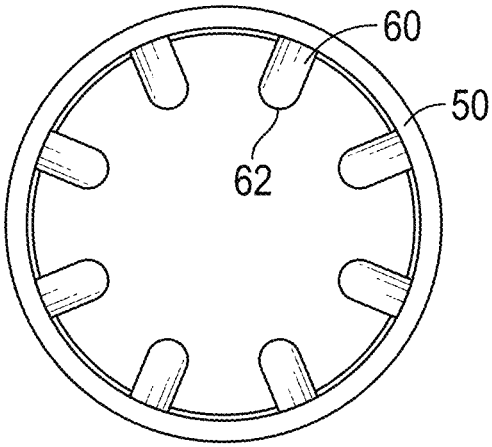
FIG. 5B is a top plan view of the sleeve of the invention, illustrating a single row of uniform-length nubs.
Figure 5C:
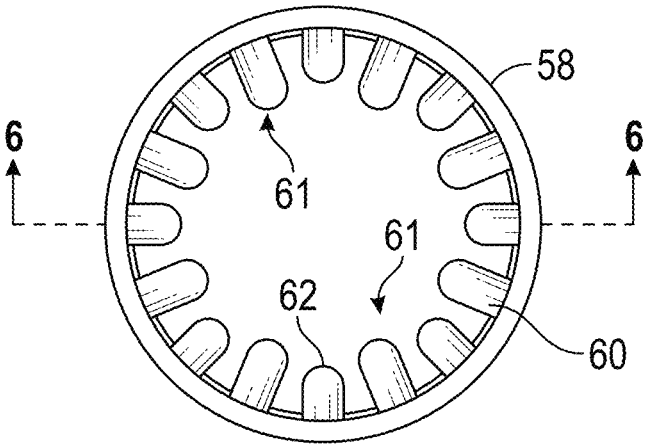
FIG. 5C is a top plan view of the sleeve of the invention, illustrating multiple rows of the nubs, some of which vary in length from some of the other nubs.
Figure 6:
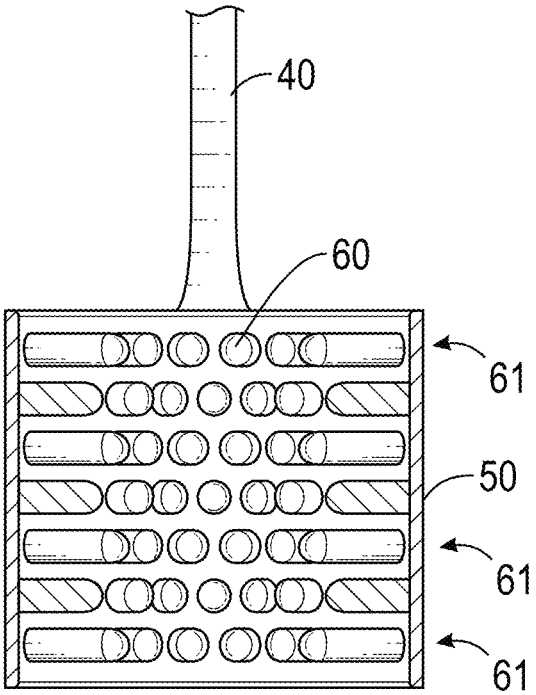
FIG. 6 is a cross-sectional view through a diameter of the sleeve, illustrating an inside of the sleeve.

The sleeve 50 has a plurality of resilient, inwardly-projecting radial nubs 60, preferably made from two or more rows 61 (FIG. 6) of a cylindrical elastomeric material originating at the sleeve 50 and terminating at a rounded distal end 62 (FIGS. 5A-5C). Such rows 61 of nubs 60 are preferably each radially offset (FIG. 5C) from the nubs 60 of the rows 61 immediately adjacent thereto, and preferably some of the nubs 60 are of differing lengths from at least some of the other nubs 60 so that the brush head 39 experiences a variety of differing sizes and locations of the nubs 60 when being cleaned thereby. Moreover, the nubs 60 may also be oriented at varying angles with respect to the sleeve upwardly or downwardly. The rubber or elastomeric nubs 60 preferably traverse the sleeve 50 at apertures in the sleeve 50 (not shown), or the nubs 60 are affixed with the inside of the sleeve 50 by sonic welding, adhesive, or the like (not shown). The nubs 60 are preferably between 3 and 12 mm in diameter, and between 1 and 3 cm in length.

Figure 4:
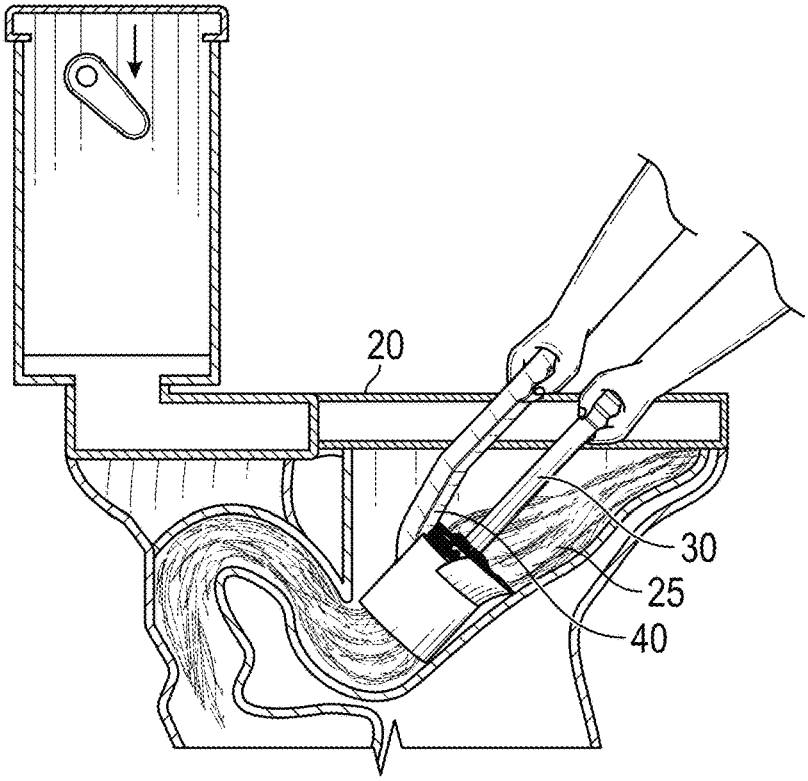
FIG. 4 is a side cross-sectional diagram of the toilet showing the user cleaning the toilet brush with the toilet brush cleaner in a flow of flushed water from the toilet.

In use, with the user holding the brush cleaner 40 in one hand and the toilet brush 30 in another hand, the user can repeatedly insert and withdraw the brush 30 from the open sleeve 50, preferably while rotating the brush 30, to clean the brush head 39 with the nubs 60 of the sleeve 50. While cleaning the brush head 39 it is helpful to insert both the sleeve and the brush head under water 25 in a toilet 20 (FIG. 3), for example. For additional cleaning and rinsing the user may flush the toilet 20 and hold the sleeve 50 and brush head 39 in the flow of the flushed water 25 (FIG. 4). For even more intensive cleaning, a few drops of dish soap or the like may be applied to the nubs 60 or brush head 39 before cleaning the brush head 39 inside the sleeve 50, and then rinsed as indicated above.

Preferably the sleeve 50 of the toilet brush cleaner 40 includes at least one water deflector 70 fixed at a top edge 58 of the sleeve 50, such that the water deflector 70 when introduced into the flow of flushed water 25 in the toilet 20 redirects a substantial portion of the flushed water 25 into the sleeve 50 to rinse the brush head 39 and nubs 60. Preferably such a water deflector 70 is resilient so as to conform to the shape of the toilet 20, is fixed on the sleeve 50 opposite the handle 45 (FIG. 1), and covers an arc $\alpha$ (FIG. 1) of at least 90-degrees or 120-degrees around the top edge 58 of the sleeve 50, the sleeve 50 preferably being substantially circular in plan view. In an alternate embodiment of the invention the sleeve 50 is U-shaped or C-shaped, as suggested by FIG. 6.

In some embodiments of the invention a base 80 (FIG. 2) is included and adapted to receive and maintain in an upright orientation the sleeve 50 and the brush 30 on a horizontal support surface 15, such as a floor surface 15. The base 80 may be made of any weighted material such as wood, plastic, ceramic, metal, or the like.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above.

The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A toilet brush cleaner for cleaning a toilet brush of the type having an elongated handle with a proximal end adapted for gripping and a distal end terminating in a brush head having a plurality of projecting brush bristles, the toilet brush cleaner comprising:

an elongated handle with a proximal end adapted for gripping and a distal end terminating in an open-ended sleeve having an open upper end and an open lower end each defined by at least a sleeve opening which extends completely through the sleeve and which is substantially uniform in size from the open upper end to the open lower end, the sleeve opening being sized to accommodate at least some of the brush bristles of the brush head of the toilet brush therein, the sleeve further having a plurality of resilient, inwardly-projecting radial nubs disposed within the sleeve opening;

wherein, when the sleeve of the toilet brush cleaner is upright such that a longitudinal center axis of the sleeve opening is oriented vertically and the open upper end of the sleeve is disposed above the open lower end of the sleeve, the handle of the toilet brush cleaner extends longitudinally upwardly beyond the open upper end of the sleeve and is laterally offset from the longitudinal center axis of the sleeve opening;

whereby with a user holding the toilet brush cleaner in one hand and the toilet brush in the other hand, the user can repeatedly insert and withdraw the toilet brush from the sleeve opening while rotating the toilet brush to clean the brush head with the nubs of the sleeve.

2. The toilet brush cleaner of claim 1 wherein the sleeve further includes at least one water deflector fixed at a top edge of the sleeve, whereby the water deflector is capable of being introduced into a flow of flushed water to redirect some of the water into the sleeve to rinse the brush head.

3. The toilet brush cleaner of claim 2 wherein the water deflector is fixed at the top edge of the sleeve opposite the handle.

4. The toilet brush cleaner of claim 3 wherein the water deflector covers an arc of at least 90-degrees.

5. The toilet brush cleaner of claim 3 wherein the water deflector covers an arc of at least 120-degrees.

6. The toilet brush cleaner of claim 1 wherein the plurality of nubs comprise two or more rows of the inwardly-projecting radial nubs.

7. The toilet brush cleaner of claim 6 wherein each of the nubs is an elastomeric cylindrical shape originating at the sleeve and terminating at a rounded distal end.

8. The toilet brush cleaner of claim 7 wherein the nubs of each row are radially offset from the nubs of any immediately adjacent row.

9. The toilet brush cleaner of claim 7 wherein at least some of the nubs are of differing lengths from some of the other nubs.

10. The toilet brush cleaner of claim 1 further including a base adapted to receive and maintain the sleeve and the brush head upright therein and to be supported on a horizontal support surface.

11. A toilet brush system for cleaning a toilet with at least water, comprising:

a toilet brush having an elongated handle with a proximal end adapted for gripping and a distal end terminating in a brush head having a plurality of projecting brush bristles; and a toilet brush cleaner having an elongated handle with a proximal end adapted for gripping and a distal end terminating in an open-ended sleeve having an open upper end and an open lower end each defined by at least a sleeve opening which extends completely through the sleeve and which is substantially uniform in size from the open upper end to the open lower end, the sleeve opening being sized to accommodate at least some of the brush bristles of the brush head of the toilet brush therein, the sleeve further having a plurality of resilient, inwardly-projecting radial nubs disposed within the sleeve opening;

wherein, when the sleeve of the toilet brush cleaner is upright such that a longitudinal center axis of the sleeve opening is oriented vertically and the open upper end of the sleeve is disposed above the open lower end of the sleeve, the handle of the toilet brush cleaner extends longitudinally upwardly beyond the open upper end of the sleeve and is laterally offset from the longitudinal center axis of the sleeve opening;

whereby with a user holding the toilet brush cleaner in one hand and the toilet brush in the other hand, the user can repeatedly insert and withdraw the toilet brush from the sleeve opening while rotating the toilet brush to clean the brush head with the nubs of the sleeve.

12. The toilet brush system of claim 11 wherein the sleeve further includes at least one water deflector fixed at a top edge of the sleeve, whereby the water deflector is capable of being introduced into a flow of flushed water to redirect some of the water into the sleeve to rinse the brush head.

13. The toilet brush system of claim 12 wherein the water deflector is fixed at the top edge of the sleeve opposite the handle.

14. The toilet brush system of claim 13 wherein the water deflector covers an arc of at least 90-degrees.

15. The toilet brush system of claim 13 wherein the water deflector covers an arc of at least 120-degrees.

16. The toilet brush system of claim 11 wherein the plurality of nubs comprise two or more rows of the inwardly-projecting radial nubs.

17. The toilet brush system of claim 16 wherein each of the nubs is an elastomeric cylindrical shape originating at the sleeve and terminating at a rounded distal end.

18. The toilet brush system of claim 17 wherein the nubs of each row are radially offset from the nubs of any immediately adjacent row.

19. The toilet brush system of claim 17 wherein at least some of the nubs are of differing lengths from some of the other nubs.

20. The toilet brush system of claim 11 further including a base adapted to receive and maintain the sleeve and the brush head upright therein and to be supported on a horizontal support surface.

* * * * *